US012150552B2

(12) United States Patent
Yang

(10) Patent No.: US 12,150,552 B2
(45) Date of Patent: Nov. 26, 2024

(54) MULTIPURPOSE STEP STOOL

(71) Applicant: XIAMEN BABY PRETTY PRODUCTS CO., LTD., Xiamen (CN)

(72) Inventor: Jianbo Yang, Xiamen (CN)

(73) Assignee: XIAMEN BABY PRETTY PRODUCTS CO., LTD., Xiamen (CN)

( * ) Notice: Subject to any disclaimer, the term of this patent is extended or adjusted under 35 U.S.C. 154(b) by 963 days.

(21) Appl. No.: 17/171,995

(22) Filed: Feb. 9, 2021

(65) Prior Publication Data

US 2021/0169228 A1 Jun. 10, 2021

(30) Foreign Application Priority Data

Dec. 9, 2019 (CN) ..... 201922178303.3

(51) Int. Cl.
*A47C 12/00* (2006.01)

(52) U.S. Cl.
CPC ..... *A47C 12/00* (2013.01)

(58) Field of Classification Search
CPC ..... A47C 12/00; A47C 12/02; A47C 17/16
See application file for complete search history.

(56) References Cited

U.S. PATENT DOCUMENTS 4,500,146 A * 2/1985 Peterson ..... A47B 45/00 211/175
4,753,320 A * 6/1988 Walter ..... A47C 12/02 182/91
5,343,817 A * 9/1994 Abraham ..... A63J 1/00 108/97
5,354,247 A * 10/1994 Wilkinson ..... A63B 23/0458 206/505
7,240,381 B1 * 7/2007 Hawse ..... A47C 17/16 5/18.1
8,141,680 B2 * 3/2012 Wigutoff ..... E06C 1/005 182/33
8,657,069 B1 * 2/2014 Schwengels ..... A47C 12/02 182/33
8,925,682 B2 * 1/2015 Chitayat ..... A47C 12/00 182/152

* cited by examiner

*Primary Examiner* — Colleen M Chavchavadze

(74) *Attorney, Agent, or Firm* — Bayramoglu Law Offices LLC

(57) ABSTRACT

A multipurpose step stool includes a low stool and a high stool. The high stool is arranged behind the low stool. The high stool has a first accommodating cavity with a bottom opening. A size of the first accommodating cavity is equivalent to a size of the low stool. A front end surface of the high stool is provided with an accommodating opening. The accommodating opening is adapted to the back of the low stool. The back of the low stool is located in the accommodating opening and is detachably connected to the high stool. The present invention has a novel structure and ingenious design. The size of the first accommodating cavity is equivalent to the size of the low stool, and the back of the low stool is located in the accommodating opening and is detachably connected to the high stool.

3 Claims, 4 Drawing Sheets

MULTIPURPOSE STEP STOOL

CROSS-REFERENCE OF THE RELATED APPLICATIONS

This application is based upon and claims priority to Chinese Patent Application No. 201922178303.3, filed on filed on Dec. 9, 2019, the entire contents thereof are incorporated herein by reference.

TECHNICAL FIELD

The present invention relates to the field of children's products, in particular to a multipurpose step stool.

BACKGROUND

Children's step stools can also be used as normal stools, or elevating support on which one stands to reach high objects. At present, children's step stools usually include single-step stools and multi-step stools. The multi-step stool typically has a high step and a low step for different elevation needs. Existing multi-step stools are integrally formed, and the structure thereof is large. Therefore, the existing multi-step stool occupies a large space when it is transported and shipped or otherwise not in use, and it performs competently on limited occasions. It is therefore highly desirable to provide a new step stool that is easy to move and safe to stand on. In view of this, the present invention is proposed.

SUMMARY

In order to solve the above-mentioned problems existing in the prior art, an objective of the present invention is to provide a multipurpose step stool.

The present invention is implemented by a technical solution as follows:

A multipurpose step stool includes a low stool and a high stool. The high stool is arranged behind the low stool. The high stool has a first accommodating cavity with a bottom opening. A size of the first accommodating cavity is equivalent to a size of the low stool. A front end surface of the high stool is provided with an accommodating opening. The accommodating opening is adapted to the back of the low stool. The back of the low stool is located in the accommodating opening and is detachably connected to the high stool.

Further, a top locking portion is provided in the middle of a top surface of the accommodating opening. A left locking portion and a right locking portion are respectively provided at the bottom of a left side and a right side of the accommodating opening. A top locking slot is provided at the back of a top surface of the low stool for the top locking portion to adaptively insert. A left locking slot and a right locking slot are respectively provided at the back of a left side and a right side of the low stool for the left locking portion and the right locking portion to adaptively insert.

Further, a top surface of the low stool and a top surface of the high stool are respectively provided with a first non-slip pad and a second non-slip pad.

Further, the low stool has a second accommodating cavity with a bottom opening. Four first cuts are provided on an outer periphery of the low stool. The four first cuts define the low stool with four first supporting legs. A bottom surface of each first supporting leg is provided with a first non-slip bottom pad. Three second cuts are provided on an outer periphery of the high stool. The three second cuts and the accommodating opening define the high stool with four second supporting legs. A bottom surface of each second supporting leg is provided with a second non-slip bottom pad.

Compared with the prior art, the present invention has the advantages of novel structure and ingenious design. The size of the first accommodating cavity is equivalent to the size of the low stool. The back of the low stool is located in the accommodating opening and is detachably connected to the high stool. When the multipurpose step stool needs to be transported or is not in use, the low stool is detached from the high stool and then the high stool stacked above the low stool, that is, the low stool is held in the first accommodating cavity, which minimizes space occupied by the stools when stored. In addition, the low stool and the high stool are separated as two single normal stools or booster stools for two kids with flexible usage.

DETAILED DESCRIPTION OF THE EMBODIMENTS

Figure 1:
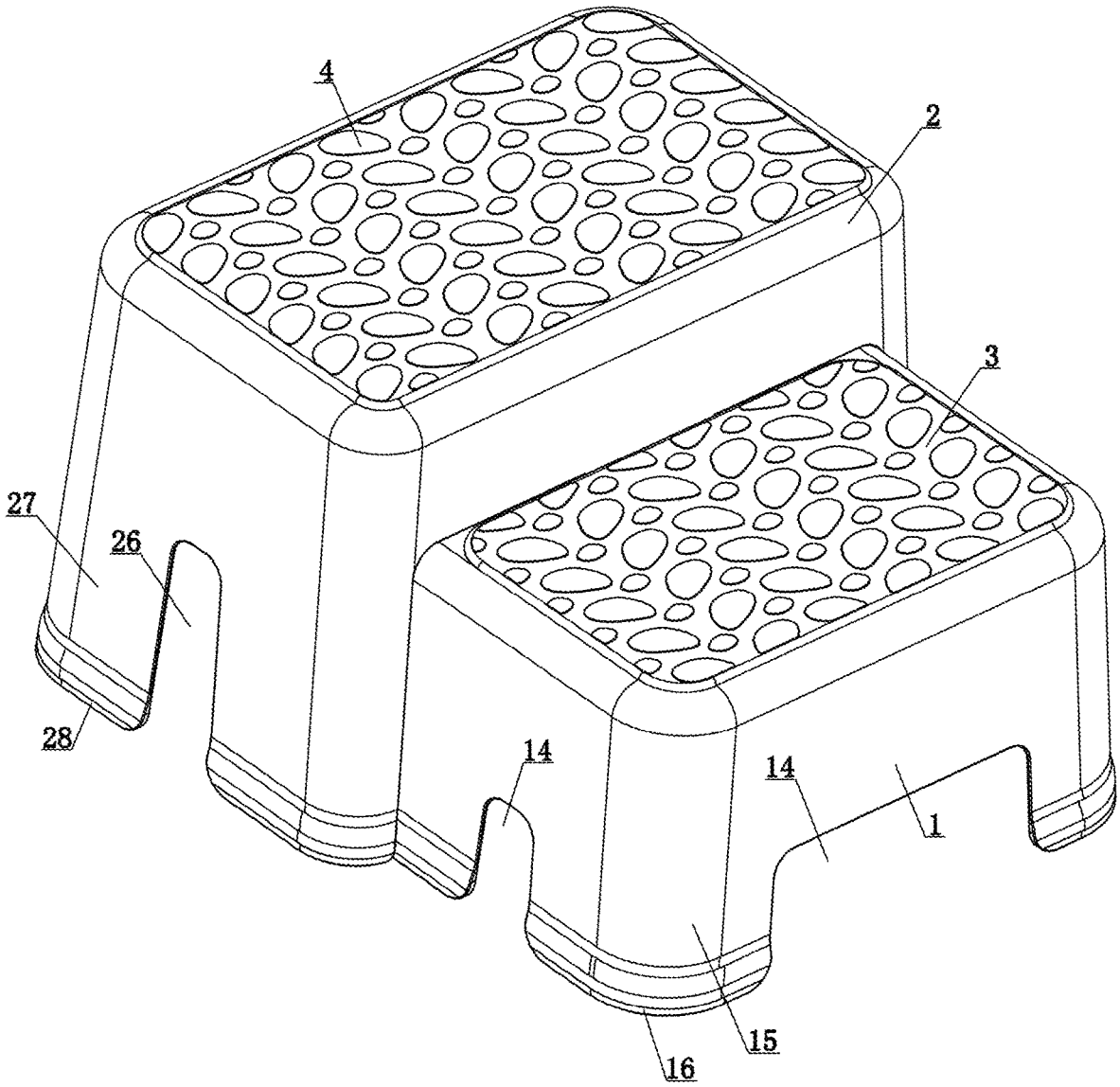
FIG. 1 is a structural diagram of the present invention.
Figure 2:
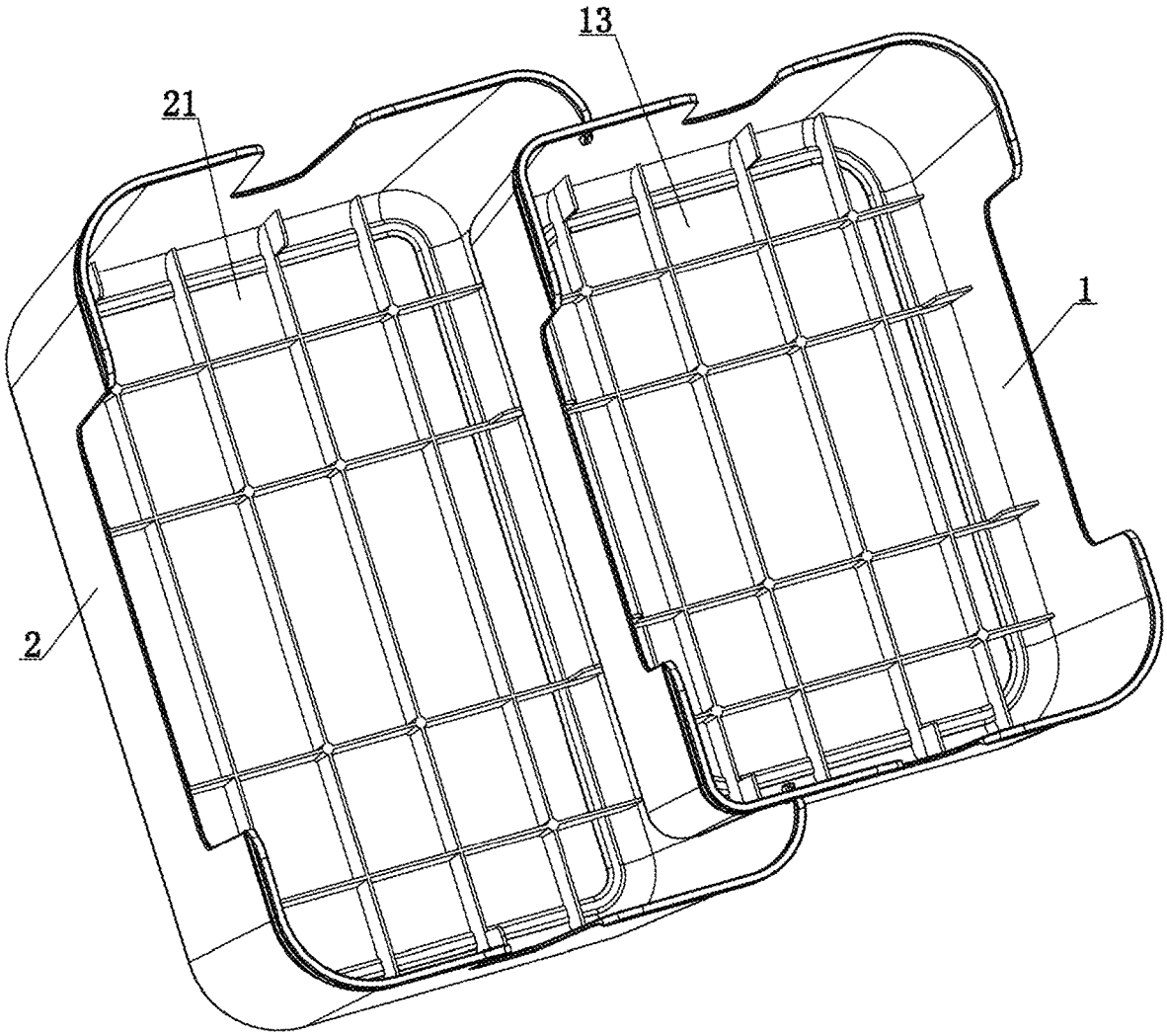
FIG. 2 is a structural diagram of the present invention in another angle of view.
Figure 3:
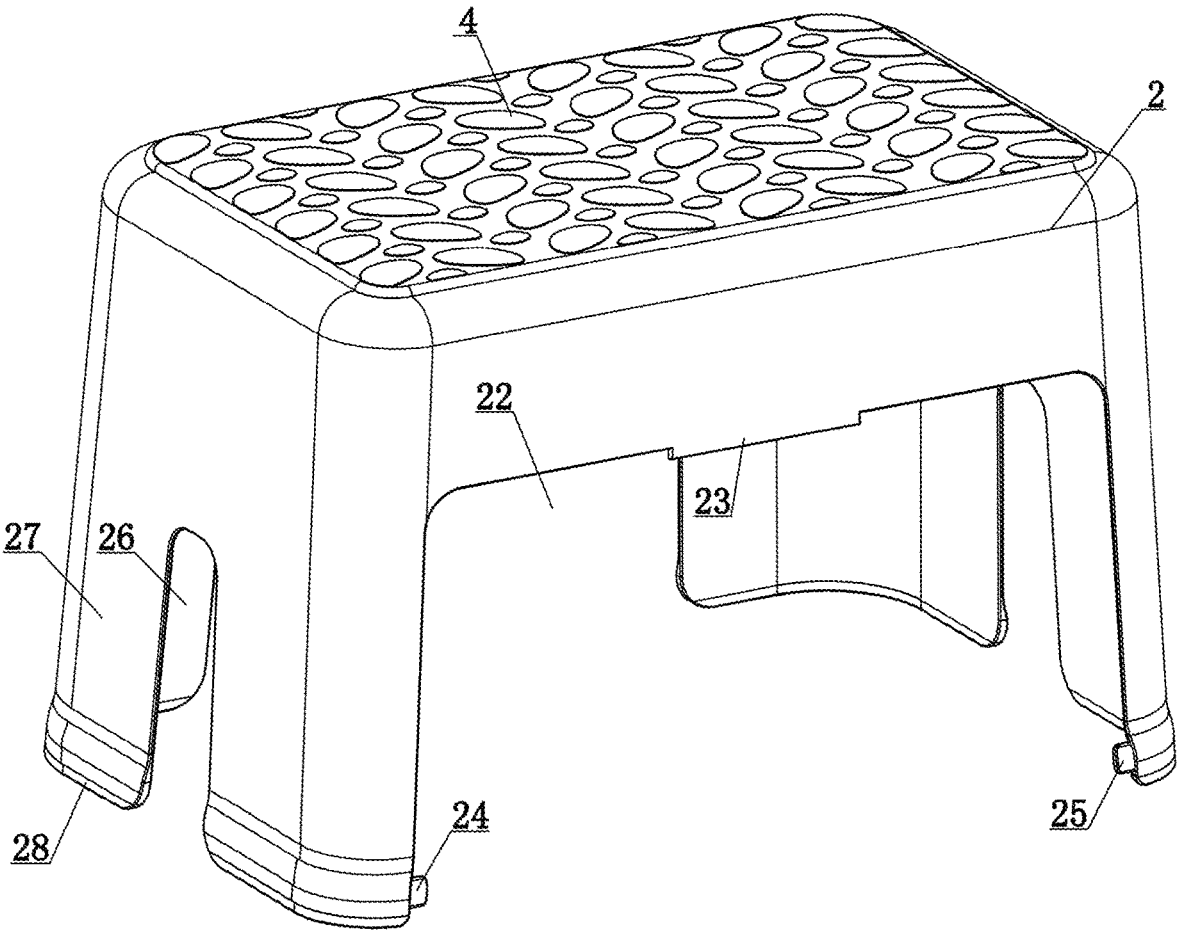
FIG. 3 is a structural diagram of a high stool of the present invention.
Figure 4:
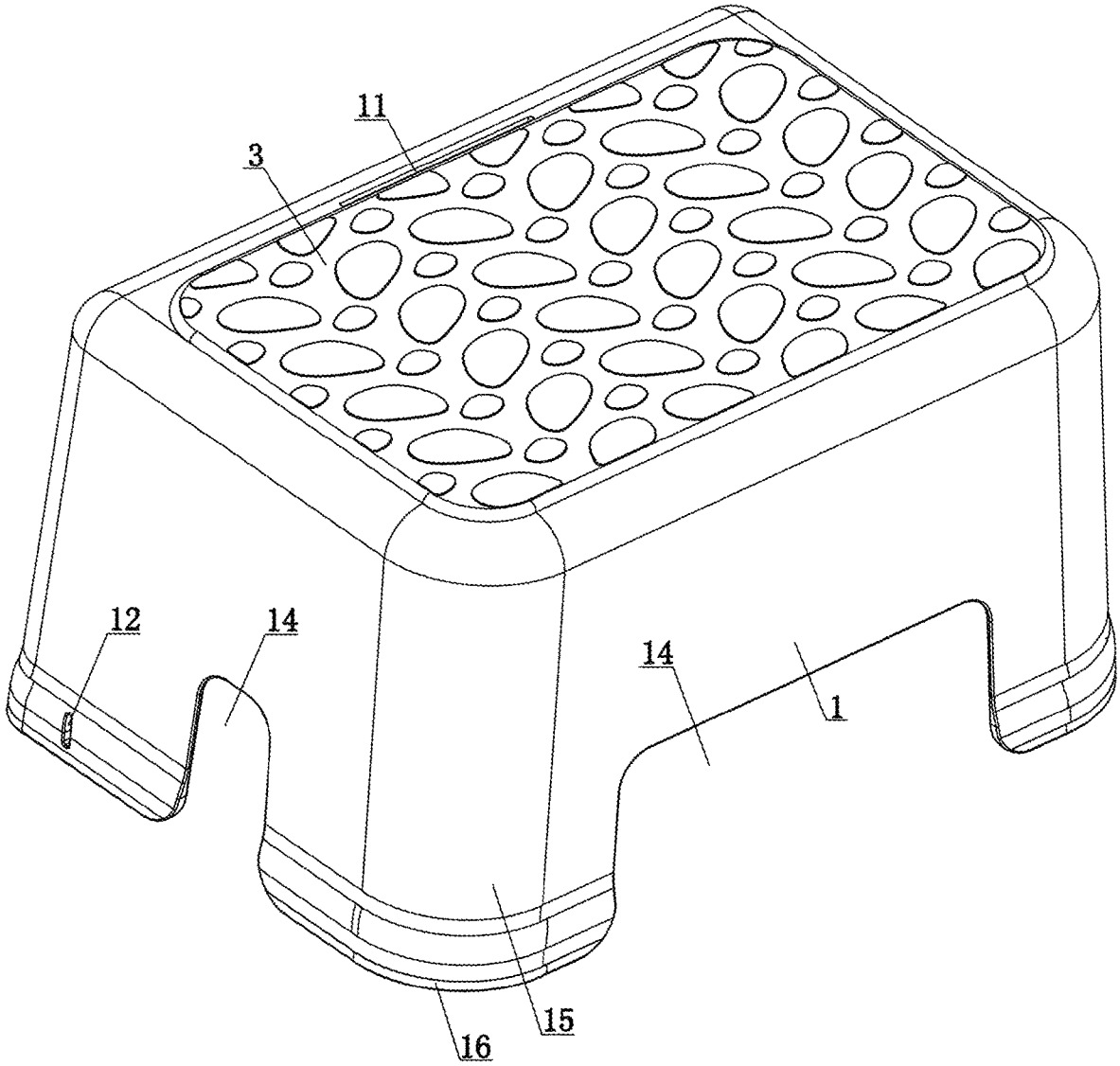
FIG. 4 is a structural diagram of a low stool of the present invention.

Referring to FIGS. 1, 3 and 4, a multipurpose step stool includes the low stool 1 and the high stool 2. The high stool is arranged behind the low stool. The high stool 2 has the first accommodating cavity 21 with a bottom opening. A size of the first accommodating cavity 21 is equivalent to a size of the low stool 1. A front end surface of the high stool 2 is provided with the accommodating opening 22. The accommodating opening 22 is adapted to the back of the low stool 1. The back of the low stool 1 is located in the accommodating opening 22 and is detachably connected to the high stool 2.

Referring to FIGS. 1, 3 and 4, the top locking portion 23 is provided in the middle of a top surface of the accommodating opening 22. The left locking portion 24 and the right locking portion 25 are respectively provided at the bottom of a left side and a right side of the accommodating opening 22. The top locking slot 11 is provided at the back of a top surface of the low stool 1 for the top locking portion 23 to adaptively insert. The left locking slot 12 and a right locking slot (not shown in the figure) are respectively provided at the back of a left side and a right side of the low stool 1 for the left locking portion 24 and the right locking portion 25 to adaptively insert. When the low stool 1 and the high stool 2 are connected, the top locking portion 23 is inserted into the top locking slot 11, and the left locking portion 24 and the right locking portion 25 are respectively inserted into the left locking slot 12 and the right locking slot (not shown in the figure). When the low stool 1 and the high stool 2 need to be separated, the left locking portion 24 and the right locking portion 25 are respectively separated from the left locking slot 12 and the right locking slot (not shown in the figure), and the top locking portion 23 is separated from the top locking slot 11.

Referring to FIGS. 1 to 4, a top surface of the low stool 1 and a top surface of the high stool 2 are respectively provided with the first non-slip pad 3 and the second non-slip pad 4. The first non-slip pad 3 and the second non-slip pad 4 are configured to prevent a child standing on the stool from slipping. The low stool 1 has the second accommodating cavity 13 with a bottom opening. Four first cuts 14 are provided on an outer periphery of the low stool 1. The four first cuts 14 define the low stool 1 with four first supporting legs 15. A bottom surface of each first supporting leg 15 is provided with the first non-slip bottom pad 16. Three second cuts 26 are provided on an outer periphery of the high stool 2. The three second cuts 26 and the accommodating opening 22 define the high stool 2 with four second supporting legs 27. A bottom surface of each second supporting leg 27 is provided with the second non-slip bottom pad 28. The first non-slip bottom pad 16 and the second non-slip bottom pad 28 are respectively configured to prevent the low stool 1 and the high stool 2 from slipping. The low stool 1 and the high stool 2 are respectively made of a plastic material.

Referring to FIGS. 1, 3 and 4, a design principle of the present invention is as follows. The size of the first accommodating cavity 21 is equivalent to the size of the low stool 1, and the back of the low stool 1 is located in the accommodating opening 22 and is detachably connected to the high stool 2. When the multipurpose step stool needs to be transported or is not in use, the low stool 1 is detached from the high stool 2 and the high stool 2 is stacked above the low stool, so that the low stool 1 is held in the first accommodating cavity 21. In this way, the space occupied by the stools is minimized. In addition, the low stool 1 and the high stool 2 can be separated as two single normal stools or booster stools for two kids to use, which makes the usage of the step stool more flexible.

The above described are merely specific implementations of the present invention, and the design concept of the present invention is not limited thereto. Any non-substantial changes made to the present invention based on the concept of the present invention should fall within the protection scope of the present invention.

What is claimed is:

1. A multipurpose step stool, comprising a low stool and a high stool, wherein the high stool is arranged behind the low stool; the high stool has a first accommodating cavity with a bottom opening; a size of the first accommodating cavity is equivalent to a size of the low stool; a front end surface of the high stool is provided with an accommodating opening; the accommodating opening is adapted to a back of the low stool; the back of the low stool is located in the accommodating opening and is detachably connected to the high stool by a top locking portion, a top locking slot, a left locking portion, a left vertically extending locking slot, a right locking portion, and a right vertically extending locking slot that allow for separation of the low stool from the high stool, wherein the top locking portion is provided in a middle of a top surface of the accommodating opening; the left locking portion and the right locking portion are respectively provided at a bottom of a left side of the accommodating opening and at a bottom of a right side of the accommodating opening; the top locking slot is provided on and parallel to a longer side of a top surface of the low stool for the top locking portion to adaptively insert therein; the left vertically extending locking slot and the right vertically extending locking slot are respectively provided on a left side of the back of the low stool and on a right side of the back of the low stool for the left locking portion and the right locking portion of the high stool to adaptively insert therein.

2. The multipurpose step stool according to claim 1, wherein a top surface of the low stool and a top surface of the high stool are respectively provided with a first non-slip pad and a second non-slip pad.

3. The multipurpose step stool according to claim 1, wherein the low stool has a second accommodating cavity with a bottom opening; four first cuts are provided on an outer periphery of the low stool; the four first cuts define the low stool with four first supporting legs; a bottom surface of each first supporting leg of the four first supporting legs is provided with a first non-slip bottom pad; three second cuts are provided on an outer periphery of the high stool; the three second cuts and the accommodating opening define the high stool with four second supporting legs; a bottom surface of each second supporting leg of the four second supporting legs is provided with a second non-slip bottom pad.

* * * * *